US007866477B2

(12) United States Patent
Sturm et al.

(10) Patent No.: US 7,866,477 B2
(45) Date of Patent: Jan. 11, 2011

(54) ORAL CARE Q2 KITS

(75) Inventors: Jennifer Sturm, Alpharetta, GA (US); Khoa Lien, Canton, GA (US); Tamika Wiggins, Fairburn, GA (US); Alan Shuman, Canton, GA (US); Michael Sleva, Atlanta, GA (US); Javier Verdura, Milford, CT (US); Joe Cesa, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 254 days.

(21) Appl. No.: 12/165,091

(22) Filed: Jun. 30, 2008

(65) Prior Publication Data

US 2009/0321298 A1 Dec. 31, 2009

(51) Int. Cl.
*B65D 69/00* (2006.01)

(52) U.S. Cl. ..... 206/570; 206/438; 206/806; 53/443

(58) Field of Classification Search ..... 206/223, 206/232, 570–572, 363, 364, 438, 459.1, 206/459.5, 504, 505, 806; 53/443, 467, 474; 128/200.26; 220/266, 276; 229/235, 240
See application file for complete search history.

(56) References Cited

U.S. PATENT DOCUMENTS

| | | | | |
|---|---|---|---|---|
| 3,759,375 | A | 9/1974 | Nappi | |
| 3,976,195 | A | 8/1976 | Cohen | |
| 5,351,819 | A * | 10/1994 | Varon | 206/232 |
| 5,378,226 | A | 1/1995 | Hanifl et al. | |
| 5,456,361 | A | 10/1995 | Walsh et al. | |
| 5,485,917 | A | 1/1996 | Early | |
| 5,542,539 | A | 8/1996 | Early | |
| 5,709,866 | A | 1/1998 | Booras et al. | |
| 5,941,394 | A * | 8/1999 | Siegler | 206/571 |
| 6,206,192 | B1 * | 3/2001 | Winstead et al. | 206/572 |
| 6,372,313 | B1 | 4/2002 | D'Alessio et al. | |
| 6,460,702 | B2 * | 10/2002 | Hammond | 206/570 |
| 6,509,007 | B2 | 1/2003 | Rajaiah et al. | |
| 6,802,174 | B2 * | 10/2004 | Krausz | 53/474 |
| 6,960,040 | B2 | 11/2005 | D'Alessio et al. | |
| 7,523,825 | B2 * | 4/2009 | Velazquez et al. | 206/440 |
| 2003/0075474 | A1 * | 4/2003 | Moyer et al. | 206/570 |
| 2004/0129581 | A1 * | 7/2004 | Tompkins | 206/223 |
| 2006/0001156 | A1 | 1/2006 | Wakiyama et al. | |

(Continued)

FOREIGN PATENT DOCUMENTS

| | | |
|---|---|---|
| CA | 1032904 A | 6/1978 |

(Continued)

OTHER PUBLICATIONS

Patent Cooperation Treaty Search Report from the International Search Authority, International Application No. PCT/IB2009/052697 dated Feb. 16, 2010.

*Primary Examiner*—Luan K Bui
(74) *Attorney, Agent, or Firm*—James B. Robinson; James Arnold

(57) ABSTRACT

An oral care kit for a defined oral care treatment cycle is provided herein. The oral care kit utilizes a substantially rectangular box having oral care packs positioned therein. The oral care packs contain oral care devices useful for administering oral care treatment during a 24 hour oral care treatment cycle.

19 Claims, 4 Drawing Sheets

U.S. PATENT DOCUMENTS

| | | | | |
|---|---|---|---|---|
| 2006/0011506 | A1 | 1/2006 | Riley | |
| 2006/0029921 | A1 | 2/2006 | Walther et al. | |
| 2006/0081486 | A1 | 4/2006 | Klein | |
| 2006/0239757 | A1 | 10/2006 | Giniger | |
| 2007/0254067 | A1* | 11/2007 | Ha | 426/71 |
| 2008/0011636 | A1 | 1/2008 | St. John et al. | |
| 2008/0145815 | A1 | 6/2008 | Hershey et al. | |
| 2008/0145816 | A1 | 6/2008 | Hershey et al. | |

FOREIGN PATENT DOCUMENTS

| | | | |
|---|---|---|---|
| CA | 2086659 | C | 1/1999 |
| CA | 2342342 | A1 | 3/2000 |
| CA | 2505572 | A1 | 4/2006 |
| EP | 1518478 | A1 | 3/2005 |
| KR | 10-0580352 | B1 | 5/2006 |
| WO | WO 00/12411 | | 3/2000 |
| WO | WO 2006/053207 | | 5/2006 |
| WO | WO 2006/073559 | | 7/2006 |
| WO | WO 2006/089139 | | 8/2006 |

* cited by examiner

ORAL CARE Q2 KITS

BACKGROUND

Various medical procedures require intubation of a patient to achieve an artificial airway. Although generally, effective, endotracheal tubes may pose hazards because secretions may accumulate on top of the tubes and/or pass by the folds of the endotracheal tube's cuff into the lungs during use. These secretions may harbor bacteria that may lead to health care associated infections such as, for example, ventilator associated pneumonia (VAP).

VAP is the leading cause of death among Health-Care Associated Infections. In this regard, some studies have shown that the hospital mortality rate of ventilated patient who develop VAP is 46 percent. Additionally, other studies have shown that VAP is responsible for 7-8% of all deaths in hospital Intensive Care Units.

Fortunately, various devices have been created to remove or neutralize dangerous secretions in the mouth or oral cavity. These devices combat growth of bacteria by focusing on plaque removal and stimulation of salivary flow within the oral cavity.

Many of these devices, however, are used infrequently or in the incorrect order. This misuse greatly decreases the efficacy of the oral care devices and increases the likelihood of the patient developing VAP. Additionally, many of these devices are stored in drawers or bins resulting in loss or contamination of devices; or delay in patient treatment with the devices.

Thus, there remains a need in the art for an economical kit which promotes frequent oral care cleaning and utilizes the various oral care devices in the most effective order for removal and/or treatment of dangerous secretions.

SUMMARY OF INVENTION

The present invention provides for an oral care kit for a defined oral care treatment cycle, desirably a 24 hour cycle. The oral care kit includes a substantially rectangular box. The box has a top section, a bottom section, a front section, a back section, a first side section, and a second side section. The oral care kit also includes a perforation along the length of the front section which bifurcates the front section into an upper front section and a lower front section. It further includes a perforation along the length of the first side section which bifurcates the first side section into an upper first side section and lower first side section, and a perforation along the length of the second side section which bifurcates the second side section into an upper second side section and lower second side section. Additionally, the oral care kit includes a plurality of vertically oriented parallel internal partitions along the length of the lower front section of the oral care kit. These vertically oriented partitions are in communication with the lower front section and back section of the oral care kit and define a plurality of wells. A plurality of oral care packs are positioned within each individual well. This plurality of packs corresponds to the number and mix of packs required for the defined oral care kit treatment cycle.

The oral care kit may further include a plurality of colors. These colors correspond to the plurality of wells and are displayed on the front section of the substantially rectangular box. That is, the plurality of oral care packs positioned within each well display a color corresponding to the color displayed on the portion of the front section of the substantially rectangular box parallel to the well.

Additionally, the oral care kit may include an attachment means in communication with the back section. The attachment means may desirably be a hook, an adhesive, or combinations thereof.

The plurality of oral care packs positioned within each well include toothbrush packs, catheter packs, suction swab packs with hydrogen peroxide, suction swab packs with alcohol free mouthwash, or combinations thereof. Additionally one or more prep packs may be in communication with at least a portion of the plurality of oral care packs. These prep packs may be positioned within the oral care kit by use of a prep pack holder.

Desirably, the oral care kit is configured wherein each of the toothbrush packs, catheter packs, suction swab packs with hydrogen peroxide, and suction swab packs with alcohol free mouthwash are adapted to be used only once in a 24 hour period, and wherein the ratio of prep packs, toothbrush packs, catheter packs, suction swab packs with hydrogen peroxide, and suction swab packs with alcohol free mouthwash is 1:2:2:4:6, respectively.

Another aspect of the invention addresses an oral care kit for a defined oral care treatment cycle. The oral care kit includes a substantially rectangular box. The box has a top section, a bottom section, a front section, a back section, a first side section, and a second side section. The oral care kit also includes a perforation along the length of the front section which bifurcates the front section into an upper front section and a lower front section. It further includes a perforation along the length of the first side section which bifurcates the first side section into an upper first side section and lower first side section, and a perforation along the length of the second side section which bifurcates the second side section into an upper second side section and lower second side section. The oral care kit further includes a plurality of oral care packs positioned within the substantially rectangular box. The plurality of packs are oriented vertically and arranged sequentially by order of use and correspond to the number and mix of packs required for the defined oral care kit treatment cycle.

Yet another aspect of the invention addresses a method for providing an oral care kit for a defined oral care treatment cycle. The method includes providing a substantially rectangular box. The box has a top section, a bottom section, a front section, a back section, a first side section, and a second side section. The box also includes a perforation along the length of the front section which bifurcates the front section into an upper front section and a lower front section. It further includes a perforation along the length of the first side section which bifurcates the first side section into an upper first side section and lower first side section, and a perforation along the length of the second side section which bifurcates the second side section into an upper second side section and lower second side section. The method also includes providing a plurality of oral care packs positioned within the substantially rectangular box. The plurality of packs are oriented vertically and arranged sequentially by order of use and correspond to the number and mix of packs required for the defined oral care kit treatment cycle.

DETAILED DESCRIPTION

The present invention provides for oral care kits for facilitation of patient care and prevention of Health Care Associated Infections, for example, Ventilator Associated Pneumonia (VAP). These kits include oral care packs which are arranged within the kit to promote timely, accurate, and effective oral care cleanings.

The invention will be described with reference to the following description and figures which illustrate certain embodiments. It will be apparent to those skilled in the art that these embodiments do not represent the full scope of the invention which is broadly applicable in the form of variations and equivalents as may be embraced by the claims appended hereto. Furthermore, features described or illustrated as part of one embodiment may be used with another embodiment to yield still a further embodiment. It is intended that the scope of the claims extend to all such variations and embodiments.

Figure 1:
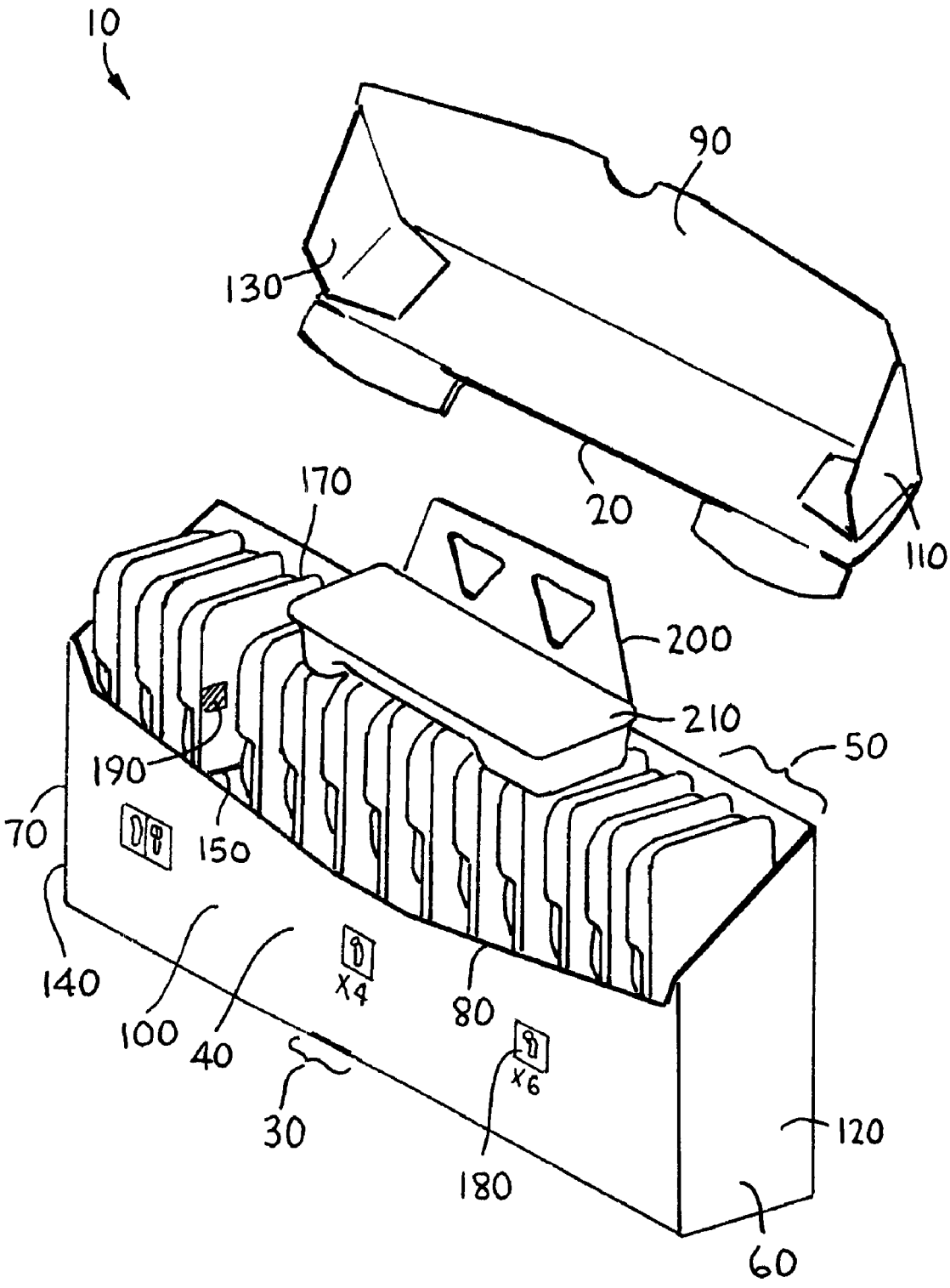
FIG. 1 is a perspective view of an oral care kit with a bifurcated front section and side sections.

Referring to FIG. 1, an oral care kit 10 is provided. The oral care kit includes a substantially rectangular box. The box has a top section 20, a bottom section 30, a front section 40, a back section 50, a first side section 60, and a second side section 70. The oral care kit has a perforation 80 along the length of the front section 40 which bifurcates the front section into an upper front section 90 and a lower front section 100, a perforation along the length of the first side section 60 which bifurcates the first side section into an upper first side section 110 and lower first side section 120, and a perforation along the length of the second side section 70 which bifurcates the second side section 70 into an upper second side section 130 and lower second side section 140. Additionally, the oral care kit includes a plurality of vertically oriented parallel internal partitions 150 along the length of the lower front section of the oral care kit. These vertically oriented partitions 150 are in communication with the lower front section 100 and back section 50 of the oral care kit and define a plurality of wells.

The oral care kit may be made from any conventional packaging materials known in the art for having sufficient rigidity to function as packaging. The materials include, but are not limited to, fiber board, paper, plastics, composites and the like.

Returning to FIG. 1, the oral care kit further includes a plurality of oral care packs 170 positioned within each individual well and adapted to house oral care devices for use in a defined oral care treatment cycle.

The individual oral care packs may be manufactured by any method known in the art of manufacturing flexible containers. These methods include, but are not limited to, extrusion, injection molding, blow molding, and thermoforming. When thermoforming is utilized, the oral care packs are formed using conventional thermoforming equipment and conventional thermoforming processes. The thermoforming process typically consists of an initial stage wherein a sheet of flexible material, desirably plastic is heated to a sufficient temperature where it is effectively formable. Then, the heated plastic sheet is placed over a mold having cavities conforming to the desired structure of the oral care pack. Next, a vacuum is drawn through perforations in the mold to form the plastic into a configuration which conform to the contours of the mold. Next, the formed plastic sheet is cooled to a temperature below its moldable state, and the formed component is then removed from the mold.

The plastic sheeting, which can be used to manufacture the oral care packs of the present invention includes suitable, conventional plastic sheeting materials known in the art such as, by way of non-limiting examples, polyethylene terephthalate(PETE), polyvinyl chloride (PVC), polypropylene(PP) and polystyrene(PS), polyurethane (PU) and the like. The thickness of the plastic sheet material is sufficiently thick to effectively provide sufficient support to the oral care devices housed within the oral care packs. The thicknesses may, for example, vary from about 0.010 inches to about 0.060 inches.

Additionally, the oral care packs contain a cover, which is also desirably, made from a plastic material. The cover is attached to the oral care pack by conventional sealing techniques such as heat sealing, pressure sealing, ultrasonic sealing, application of adhesives, or the like.

Regardless of the method of manufacture of the individual oral care packs, the plurality of packs corresponds to the number and mix of packs required for the defined oral care kit treatment cycle, desirably a 24 hour treatment cycle.

Figure 2:
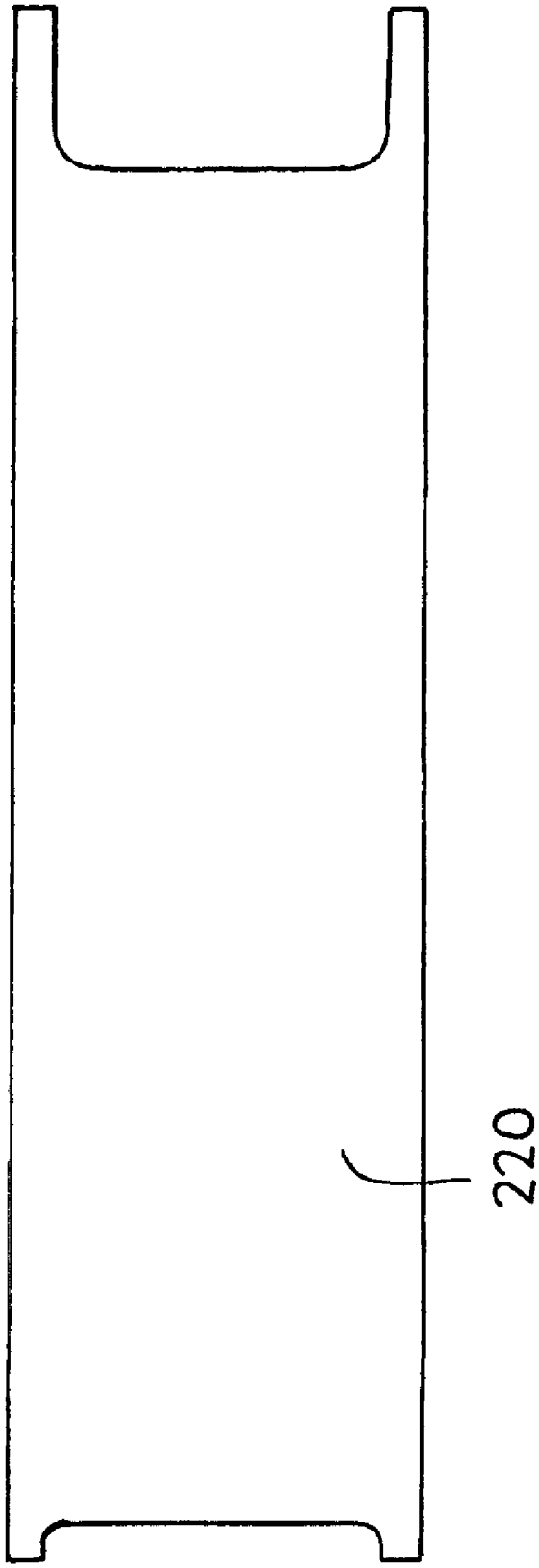
FIG. 2 is a perspective view of a prep pack holder for positioning a prep pack within the oral care kit.
Figure 3:
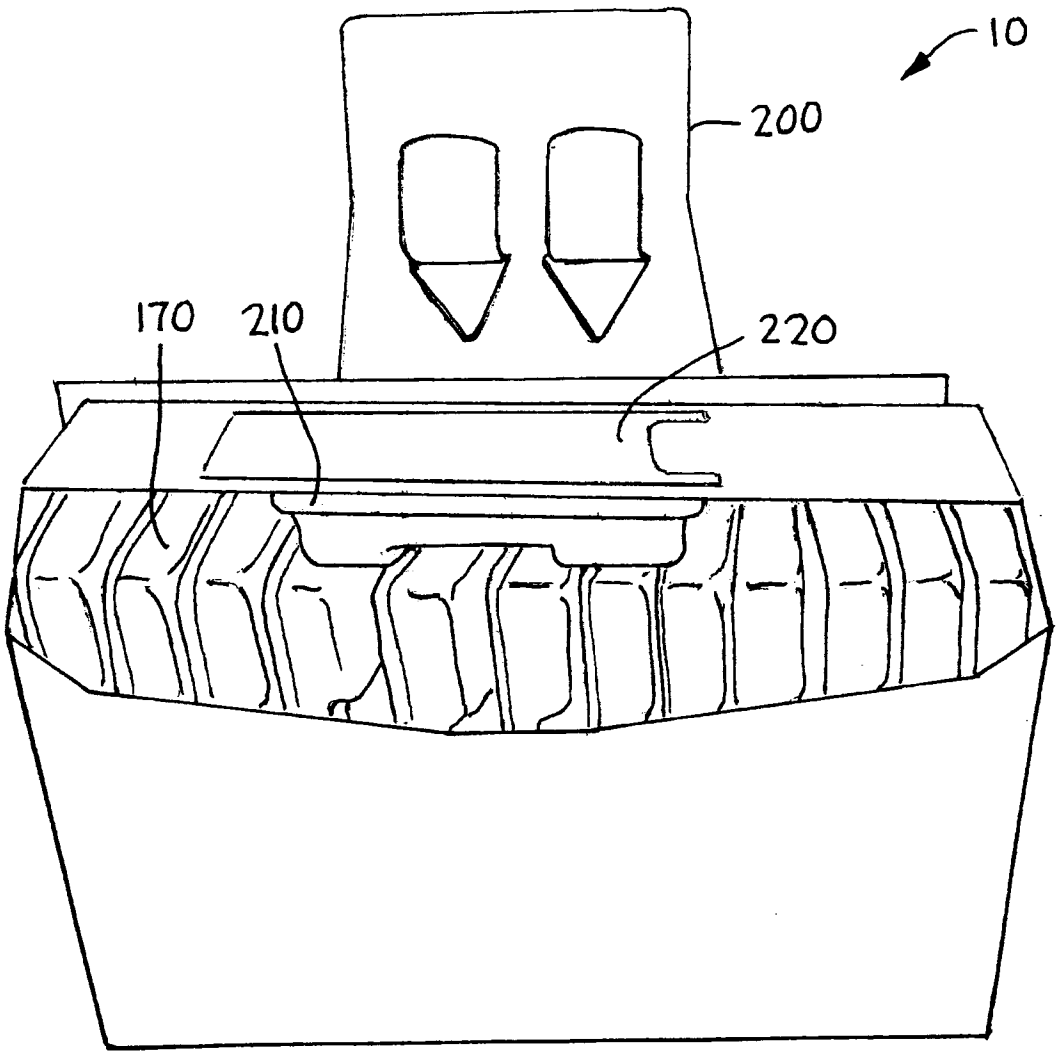
FIG. 3 is a perspective view of an oral care kit having a prep pack positioned with the oral care kit.

In this regard, the plurality of packs include suction swab packs with hydrogen peroxide, toothbrush packs, suction swab packs with alcohol free mouthwash, and suction catheters. The number of toothbrush packs, catheter packs, suction swab packs with hydrogen peroxide, and suction swab packs with alcohol free mouthwash is 2:2:4:6, respectively. Referring to FIGS. 1-3, the oral care kit also, desirably, includes at least one prep pack 210 held in place within the oral care kit by use of a prep pack holder 220.

The toothbrush pack includes a suction toothbrush, an applicator swab, an antiplaque solution, and a mouth moisturizer. The toothbrush pack is typically used at the beginning of a 24 hour oral care cycle and after 12 hours of the cycle has elapsed. Use of the suction toothbrush, as known in the art, facilitates brushing and suctioning of bacteria from the teeth and oral tissues by mechanically displacing dental plaque. It also facilitates delivery of the antiplaque solution to the teeth and gums for prevention and neutralization of bacteria. The applicator swab, formed of a plastic cylindrical chamber having a foam cushion at one end, as known in the art, allows the mouth moisturizer to be applied to the gum tissues. This helps moisturize the mouth to prevent mouth dryness and corresponding patient discomfort. Additionally, the applicator swab could be used to apply antiplaque solution to the teeth and/or gums.

The suction swab packs with hydrogen peroxide include a suction swab, an applicator swab, hydrogen peroxide, and a mouth moisturizer. The suction swab pack with hydrogen peroxide is typically used after 4, 8, 16, and 20 hours of the 24 hour oral care cycle. Use of the suction swab facilitates removal and suctioning of oral debris and secretion from the gums. The soft, foam sponge, on its end stimulates blood flow within, cleans, and freshens the oral mucosa to maintain healthy gums and decrease the likelihood of bacterial invasion and colonization of the oral cavity. Similarly, the applicator swab facilitates delivery of the hydrogen peroxide debriding solution to the gums for removal of secretions and plaque from the gums. Additionally, the applicator swab may be used to deliver a mouth moisturizer to the gum tissues to moisturize the mouth to prevent mouth dryness and corresponding patient discomfort.

The suction swab packs with alcohol free mouthwash are similar in function to the suction swab packs with hydrogen peroxide. The suction swab packs with alcohol free mouthwash is advantageous because hydrogen peroxide can only be applied to the gums safely four times over a 24 hour period because of its extensive debriding capability. By substituting the hydrogen peroxide for alcohol free mouthwash, secretions, plaque, and bacteria may be removed from the gums 6 additional times during the 24 hour treatment cycle without harming or drying out the gums. In this regard, the suction swab packs with alcohol free mouthwash are typically used after 2, 6, 10, 14, 18, and 22 hours of the 24 hour oral care treatment cycle. The mouthwash also provides the advantage of freshening the breath of the patient for the comfort of both the patient and caregiver.

The suction catheter pack includes a suction catheter. The suction catheter provides high efficiency suctioning to not only remove secretions from the mouth, but also to remove secretions from oropharyngeal cavity, including removing secretions from above an inflated endotracheal cuff when a patient is intubated. Although 2 suction catheter packs are desirably included with the oral care kit, the suction catheters may be used, as necessary, at any time during the 24 hour treatment cycle.

Additionally, the oral care kit includes one or more prep packs. These prep packs include a Yankauer, a suction handle, and a Y-adapter. Yankauer devices, suction handles, and Y-adapters and associated methods of particular usefulness with the invention are described in U.S. Pat. Pub. No. 20080145815 and U.S. application Ser. No. 11/901,119 both to Hershey et al, with both being incorporated herein by reference in their entirety. Similar to the suction catheter pack, the components of the prep pack facilitate removal of secretions from the oral care cavity. The prep pack may be used at any time during the 24 hour oral care cycle.

Advantageously, each of the oral care packs is wrapped individually. This prevents contamination and cross-contamination of oral care devices prior to use. Additionally, each of the toothbrush packs, catheter packs, suction swab packs with hydrogen peroxide, and suction swab packs with alcohol free mouthwash are adapted to be used only once, because the number of packs required for the 24 hour oral care treatment cycle are included within the oral care kit. This prevents reusing of contaminated oral care devices and prevents repetition of treatment steps that have already been completed and omission of steps that need to be completed.

As discussed earlier, the oral care kit may contain a plurality of colors corresponding to plurality of wells holding the oral care packs. These colors are displayed on the front section 180 of the substantially rectangular box. That is, the plurality of oral care packs positioned within each well display a color 190 corresponding to the color 180 displayed on the portion of the front section of the substantially rectangular box parallel to the well. For example, and by way of illustration only, all suction catheters packs located within an individual well may display an orange color on its cover, and a corresponding orange color will be displayed on a portion of the front section of the oral care kit that is parallel to the individual well. This enables a care giver to ensure he or she is selecting the correct oral care pack by confirming the visual graphic on the front of the oral care kit with the visual graphic on the oral care pack covers located within the well. Similarly, a different or the same color may be chosen for the suction swab packs with hydrogen peroxide, toothbrush packs with antiplaque mouthwash, and suction swab packs with alcohol free mouthwash. Additionally, other indicia, including alphanumeric characters may be utilized in place of or in conjunction with the plurality of colors.

Additionally, the oral care kit may contain an attachment means 200 in communication with the back section. The attachment means allows the oral care kit to be stored in a suitable location so that it may be readily available for use by the care giver. Non-limiting examples of attachment means include a hook, loop, hook receptacle, Velcro, an adhesive, or combinations, thereof.

Figure 4:
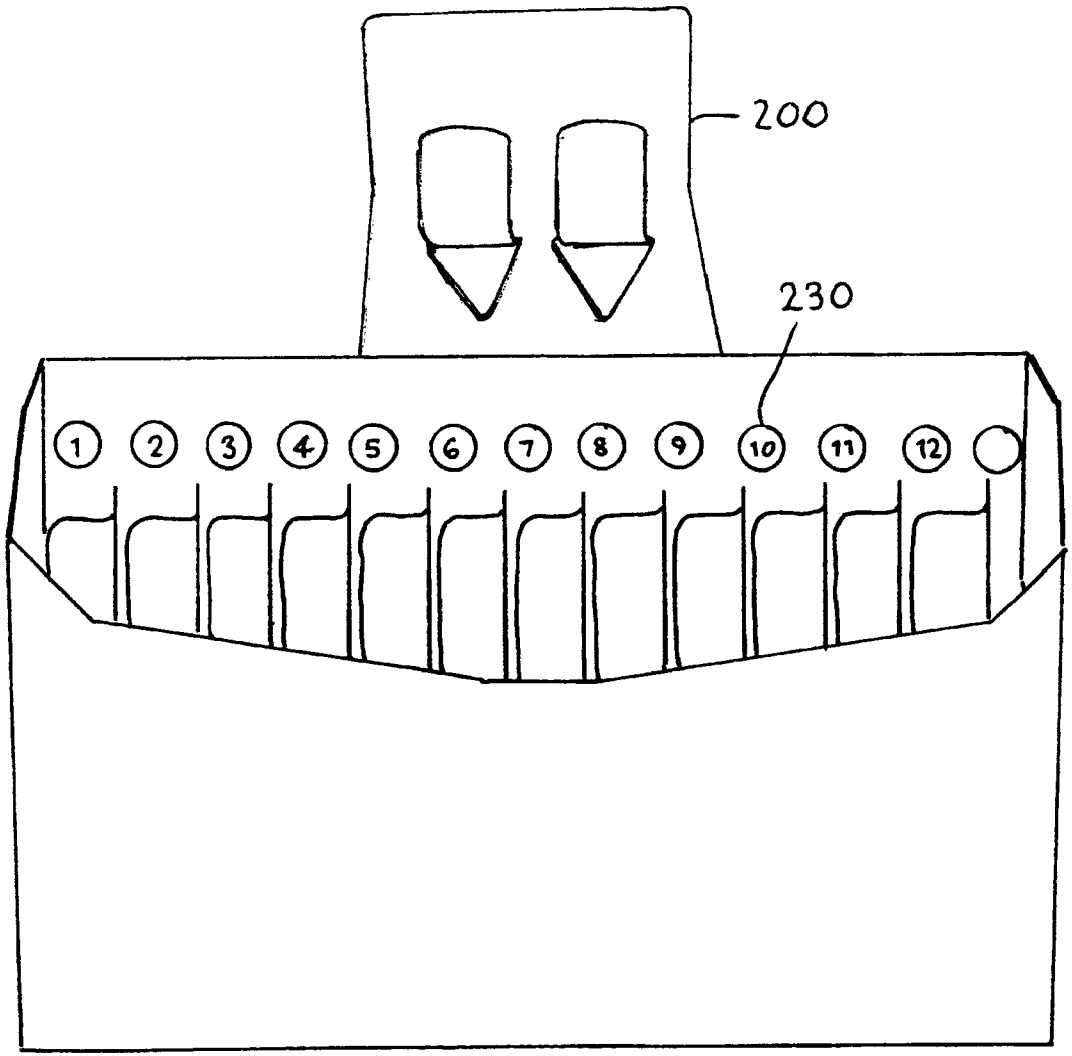
FIG. 4 is a perspective view of an oral care kit arranged sequentially by order of use.

Turning to FIG. 1 and FIG. 4, an alternative embodiment of the oral care kit is provided. The oral care kit includes a substantially rectangular box. The box has a top section 20, a bottom section 30, a front section 40, a back section 50, a first side section 60, and a second side section 70. The oral care kit has a perforation 80 along the length of the front section 40 which bifurcates the front section into an upper front section 90 and a lower front section 100, a perforation along the length of the first side section 60 which bifurcates the first side section into an upper first side section 110 and lower first side section 120, and a perforation along the length of the second side section 70 which bifurcates the second side section 70 into an upper second side section 130 and lower second side section 140.

The oral care kit further includes a plurality of oral care packs 170 positioned within the substantially rectangular box. The plurality of packs are oriented vertically and arranged sequentially by order of use, and correspond to the number and mix of packs required for the defined oral care kit treatment cycle. That is, each type of oral care pack displays a unique color that is displayed on the front section of the substantially rectangular box. A corresponding color coded alpha, numeric, or alphanumeric character 230, corresponding to the color displayed on an individual oral care pack is displayed on the back section of the substantially rectangular box and is parallel to the individual oral care pack with which it corresponds.

For example, and by way of illustration only, a toothbrush pack may be represented on the front of the substantially rectangular box by use of the color red. Because toothbrush packs are typically used at the beginning of the 24 hour oral care treatment cycle and after 12 hours (each cycle typically using a different pack every 2 hours), a "red" number 1 could be displayed on the back section, which would indicate that it is the first oral care pack to be used and a red" number 6 could be displayed on the back section for the second toothbrush pack, indicating that it should be used after hour 12 of the 24 hour oral care treatment cycle. Having this arrangement decreases the chances of utilizing the wrong oral care pack or utilizing an oral care pack out of treatment order. Similar arrangements may be constructed for the other types of oral care packs to be utilized within the oral care treatment cycle.

The invention claimed is:

1. An oral care kit for a defined oral care treatment cycle, the oral care kit comprising:

a substantially rectangular box having a top section, a bottom section, a front section, a back section, a first side section, and a second side section;

a perforation along the length of the front section which bifurcates the front section into an upper front section and a lower front section;

a perforation along the length of the first side section which bifurcates the first side section into an upper first side section and lower first side section;

a perforation along the length of the second side section which bifurcates the second side section into an upper second side section and lower second side section;

a plurality of vertically oriented parallel internal partitions along the length of the lower front section of the oral care kit, and in communication with the lower front section and back section of the oral care kit, the plurality of vertically oriented parallel internal partitions being adapted to define a plurality of wells;

a plurality of oral care packs positioned within each well, the plurality of packs corresponding to the number and mix of packs required for the defined oral care kit treatment cycle; and an attachment means for storage in a suitable location in communication wth said back section.

2. The oral care kit of claim 1, wherein a plurality of colors corresponding to the plurality of wells are displayed on the front section of the substantially rectangular box.

3. The oral care kit of claim 2, wherein the plurality of oral care packs positioned within each well displays a color corresponding to the color displayed on the portion of the front section of the substantially rectangular box parallel to the well.

4. The oral care kit of claim 1, wherein the attachment means is a hook, loop, an adhesive, or combinations thereof.

5. The oral care kit of claim 1, wherein the plurality of oral care packs are toothbrush packs, catheter packs, suction swab packs with hydrogen peroxide, suction swab packs with alcohol free mouthwash, or combinations thereof.

6. The oral care kit of claim 5, wherein the plurality of oral care packs further includes one or more prep packs.

7. The oral care kit of claim 6, wherein the one or more prep packs is in communication with at least a portion of the plurality of oral care packs, wherein the one or more prep packs are adapted to be positioned within the oral care kit by use of a substantially rectangular prep pack holder.

8. The oral care kit of claim 7, wherein the ratio of prep packs, toothbrush packs, catheter packs, suction swab packs with hydrogen peroxide, and suction swab packs with alcohol free mouthwash is 1:2:2:4:6, respectively.

9. The oral care kit of claim 8, wherein each of the toothbrush packs, catheter packs, suction swab packs with hydrogen peroxide, and suction swab packs with alcohol free mouthwash are adapted to be used only once in a 24 hour period.

10. An oral care kit for a defined oral care treatment cycle, the oral care kit comprising:

a substantially rectangular box having a top section, a bottom section, a front section, a back section, a first side section, and a second side section;

a perforation along the length of the front section which bifurcates the front section into an upper front section and a lower front section;

a perforation along the length of the first side section which bifurcates the first side section into an upper first side section and lower first side section;

a perforation along the length of the second side section which bifurcates the second side section into an upper second side section and lower second side section;

a plurality of oral care packs positioned within the substantially rectangular box, the plurality of packs corresponding to the number and mix of packs required for the defined oral care kit treatment cycle; and an attachment means for storage in a suitable location in communication wth said back section.

11. The oral care kit of claim 10, wherein the plurality of oral care packs are toothbrush packs, catheter packs, suction swab packs with hydrogen peroxide, suction swab packs with alcohol free mouthwash, or combinations thereof.

12. The oral care kit of claim 11, wherein each type of oral care pack displays a unique color and wherein each unique color is displayed on the front section of the substantially rectangular box.

13. The oral care kit of claim 11, wherein each oral care pack is oriented vertically and arranged sequentially by order of use within the substantially rectangular box, wherein a color coded number, corresponding to the color displayed on the individual oral care pack, is visibly displayed on the back section of the substantially rectangular box, and wherein each color coded number is substantially parallel to the oral care pack with which it corresponds.

14. The oral care kit of claim 11, wherein the plurality of oral care packs further includes one or more prep packs.

15. The oral care kit of claim 14, wherein the one or more prep packs is in communication with at least a portion of the plurality of oral care packs, wherein the one or more prep packs are adapted to be positioned within the oral care kit by use of a substantially rectangular prep pack holder.

16. The oral care kit of claim 15, wherein the ratio of prep packs, toothbrush packs, catheter packs, suction swab packs with hydrogen peroxide, and suction swab packs with alcohol free mouthwash is 1:2:2:4:6, respectively.

17. The oral care kit of claim 16, wherein each of the toothbrush packs, catheter packs, suction swab packs with hydrogen peroxide, and suction swab packs with alcohol free mouthwash are adapted to be used only once in a 24 hour period.

18. The oral care kit of claim 10, wherein the attachment means is a hook, loop, an adhesive, or combinations thereof.

19. A method for providing an oral care kit for a defined oral care treatment cycle, the method comprising:

providing a substantially rectangular box having a top section, a bottom section, a front section, a back section, a first side section, and a second side section;

a perforation along the length of the front section which bifurcates the front section into an upper front section and a lower front section;

a perforation along the length of the first side section which bifurcates the first side section into an upper first side section and lower first side section;

a perforation along the length of the second side section which bifurcates the second side section into an upper second side section and lower second side section;

providing a plurality of oral care packs positioned within the substantially rectangular box, the plurality of packs corresponding to the number and mix of packs required for the defined oral care kit treatment cycle; and an attachment means for storage in a suitable location in communication wth said back section.

* * * * *